US005400997A

United States Patent [19]

Payne et al.

[11] Patent Number: 5,400,997

[45] Date of Patent: Mar. 28, 1995

[54] ADJUSTABLE ANCHORING BASE FOR POSTS

[75] Inventors: Robert E. Payne; J. Edward Seay, Jr., both of Richmond, Va.

[73] Assignee: Patent Concepts, LLC, Richmond, Va.

[21] Appl. No.: 973,277

[22] Filed: Nov. 9, 1992

[51] Int. Cl.[6] ..... F16M 13/00

[52] U.S. Cl. ..... 248/523; 248/201; 52/297

[58] Field of Search ..... 248/523, 524, 548, 519, 248/520, 544, 545, 346, 357, 201, 184, 274; 52/297, 295, 296

[56] References Cited

U.S. PATENT DOCUMENTS

| | | | |
|---|---|---|---|
| 545,558 | 9/1895 | Vanbriggle | 52/296 |
| 546,161 | 9/1895 | Kimball | 52/295 |
| 816,719 | 4/1906 | Fell | 52/295 |
| 1,078,142 | 11/1913 | Hamann | 52/295 |
| 1,489,204 | 4/1924 | Glen | 52/297 |
| 1,497,822 | 6/1924 | Williams | 52/295 |
| 1,600,032 | 9/1926 | Barrick et al. | 52/295 |
| 1,647,925 | 11/1927 | May | 52/295 |
| 1,856,000 | 4/1932 | Smith | 248/519 X |
| 1,962,255 | 6/1934 | Neidinger | 248/523 X |
| 2,610,011 | 9/1952 | Lemmerman | 248/201 |
| 3,837,752 | 9/1974 | Shewchuk | 52/295 X |
| 3,988,870 | 11/1976 | Snavely | 52/297 X |
| 4,143,843 | 3/1979 | Ehrens et al. | 248/544 |
| 4,150,506 | 4/1979 | McGinnis | 248/523 X |
| 4,469,956 | 9/1984 | D'Amato | 52/295 X |
| 5,214,886 | 6/1993 | Hugron | 248/548 X |

*Primary Examiner*—David A. Scherbel
*Assistant Examiner*—Korie H. Chan
*Attorney, Agent, or Firm*—Lowe, Price, LeBlanc & Becker

[57] ABSTRACT

The invention relates to an adjustable anchoring base for road sign posts, posts which are elements of a structural system, and the like. The object of the invention is to provide a pre-manufactured permanent anchoring base, intended primarily for installation approximately flush with finish grade, which allows rapid and simple initial mounting, temporary remounting of damaged posts, plumb alignment, and secure positioning of varied types of posts. The invention is comprised of a bottom component of heavy, cast material having embedded anchor bolts protruding above its top surface, the center of said component formed as a cavity of vertically slanted and tapered faces into which a post is inserted, centered, supported and restrained horizontally at the cavity's bottom surface. The top component restrains the post both horizontally and vertically, and is comprised of adjustable anchoring plates with slotted holes, flat ring washers, and threaded nuts, all secured to the bottom component's anchor bolts.

13 Claims, 3 Drawing Sheets

FIG. 7
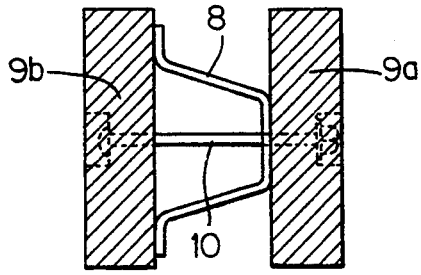
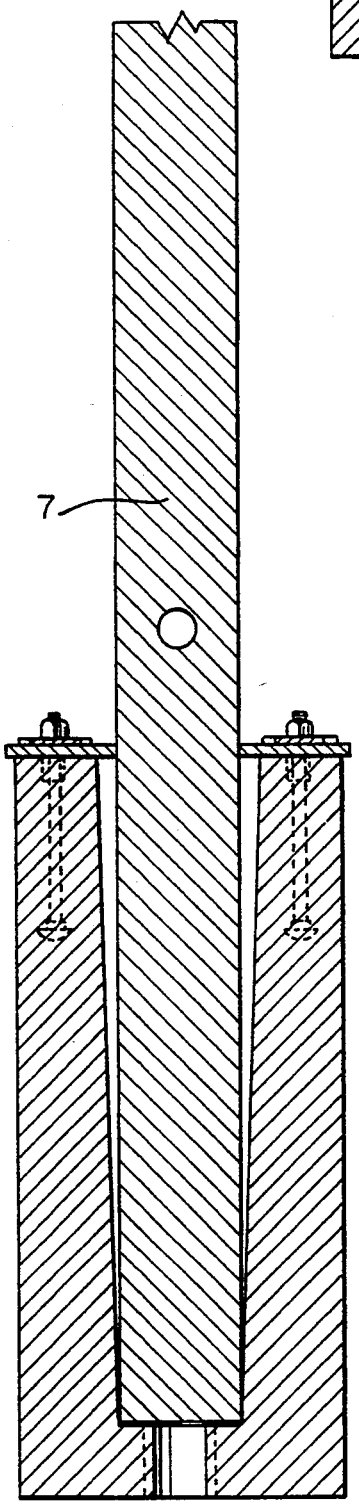
FIG. 5
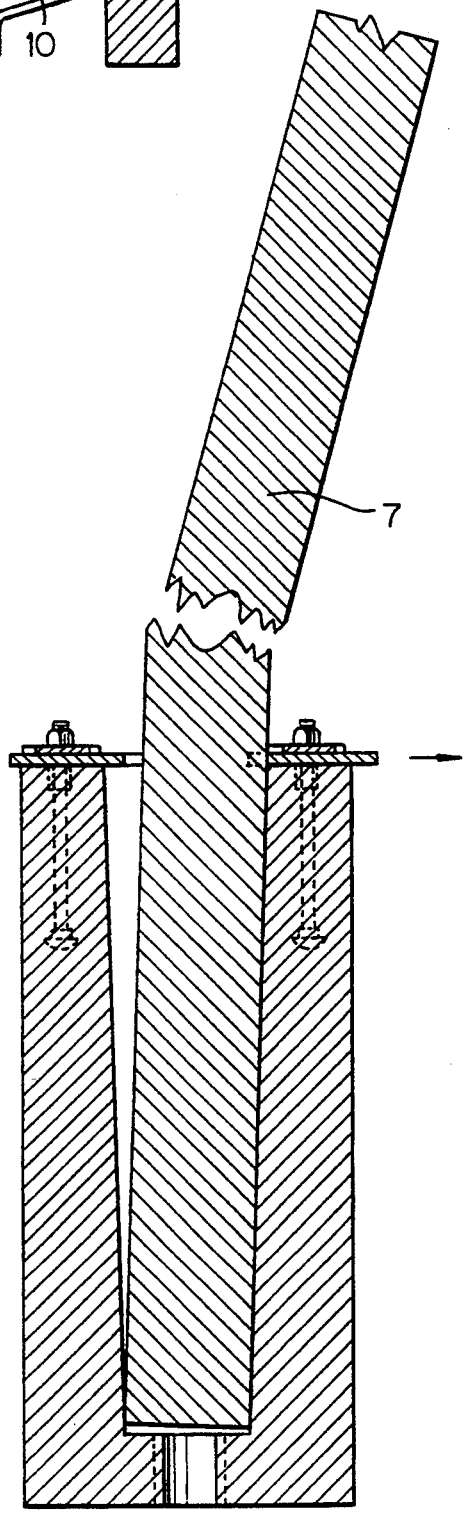
FIG. 6

ADJUSTABLE ANCHORING BASE FOR POSTS

SUMMARY OF THE INVENTION

The present invention relates to base for road sign posts of various types, for anchorage and bearing of structural post members of framed structures, by way of example the base foundation for supports of an elevated wood deck or terrace. and the like.

The principal objects of the invention are to provide a road sign post anchoring base which is easy to install in a wide variety of applicable existing and new situations, to provide savings in labor of installation and replacement of traffic sign posts, and to provide a rapid means of temporarily re-erecting an important traffic safety sign to serve prior to its permanent replacement.

It is further an object of the invention to provide highway beautification as the anchoring base would allow straight and plumb alignment of sign and marker posts as well as reduce or eliminate the need for weed control at the base of the post.

Additional principal objects of the invention are to provide the accurate placement of support base and ground anchorage of post members of various frame structures, and to provide pre-manufactured base anchors of this kind for rapid construction start-up unhindered by weather or temperature.

These objects are achieved by means of the invention, which essentially is characterized by the anchoring base comprised of a bottom component of heavy, cast material having embedded anchoring threaded devices, the center of said base formed as a cavity of vertically slanted and tapered faces into which a post is inserted, supported, centered and restrained horizontally at the cavity bottom surface. Said post is restrained both horizontally and vertically by a top component comprised of adjustable anchoring plates, flat ring washers, and threaded nuts which are in turn secured to the bottom component's anchor bolts.

DESCRIPTION OF DRAWINGS

The invention will be described in the following, reference being made to the accompanying drawings, in which FIG. 5 is the same cross-sectional view shown in FIG. 2 with the exception of showing the installed position of a typical sign post or structural frame post, FIG. 6 is the same cross-sectional view shown in FIG. 2 with the exception of showing the after-impact position of a typical sign post and its subsequent breakage, FIG. 7 is a plan view of a standard metal "U" sign post with wood spacers for Installation in the invention.

DETAILED DESCRIPTION OF INVENTION

Figure 1:
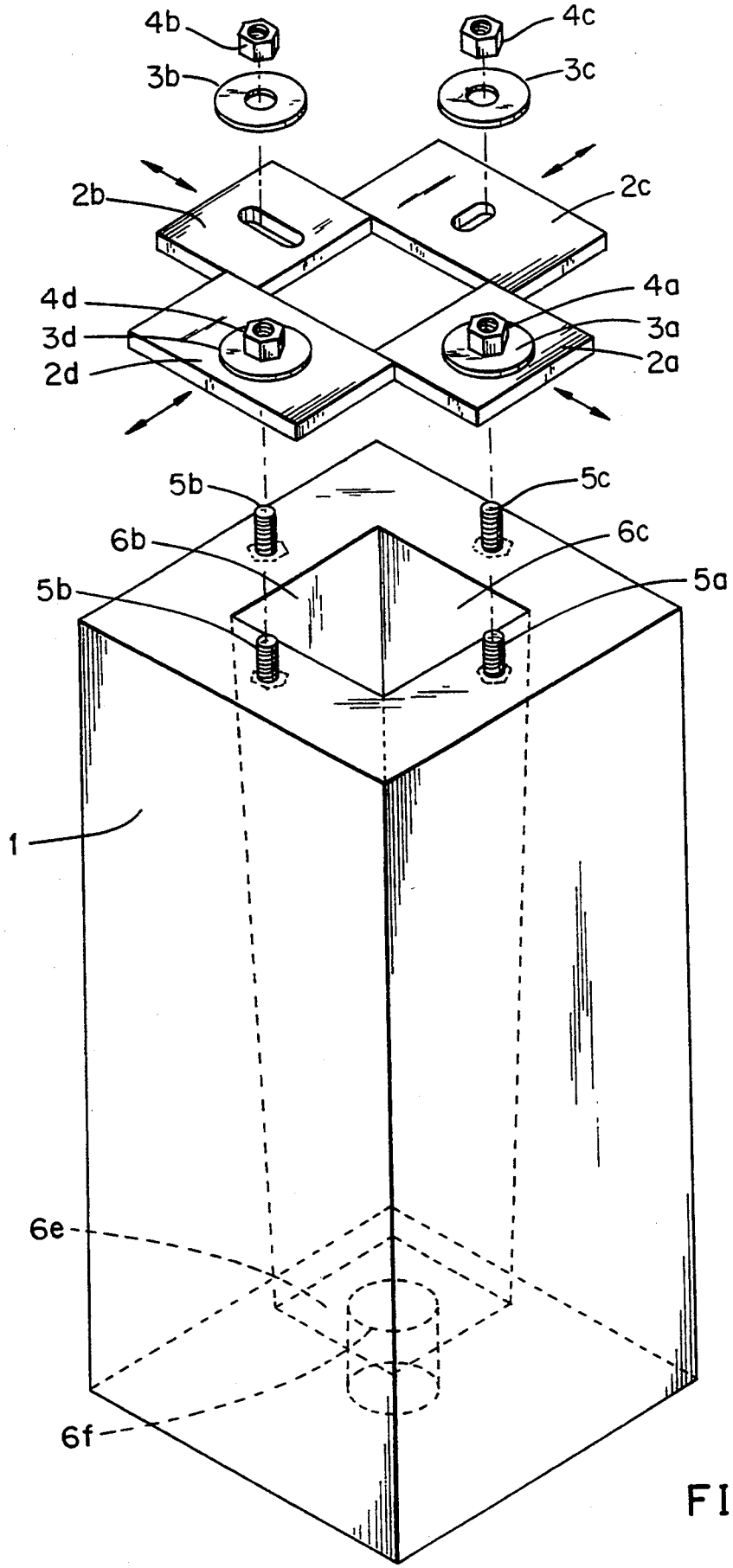
FIG. 1 is an isometric view of the entire invention with the top component shown in layered positions for clarity of concept and assembly.
Figure 4:
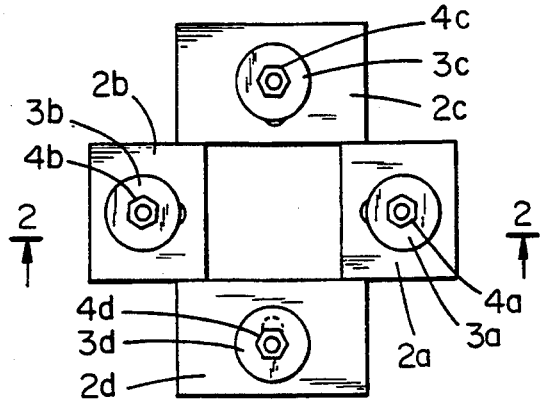
FIG. 4 is a plan view of the adjustable anchor plates, washers and nuts which comprise the top component
Figure 3:
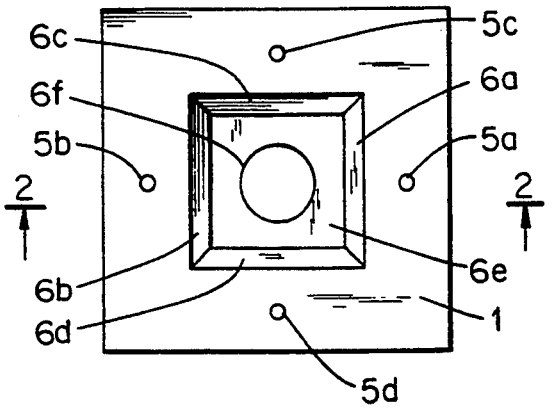
FIG. 3 is a plan view of the upper surface of the bottom component.
Figure 2:
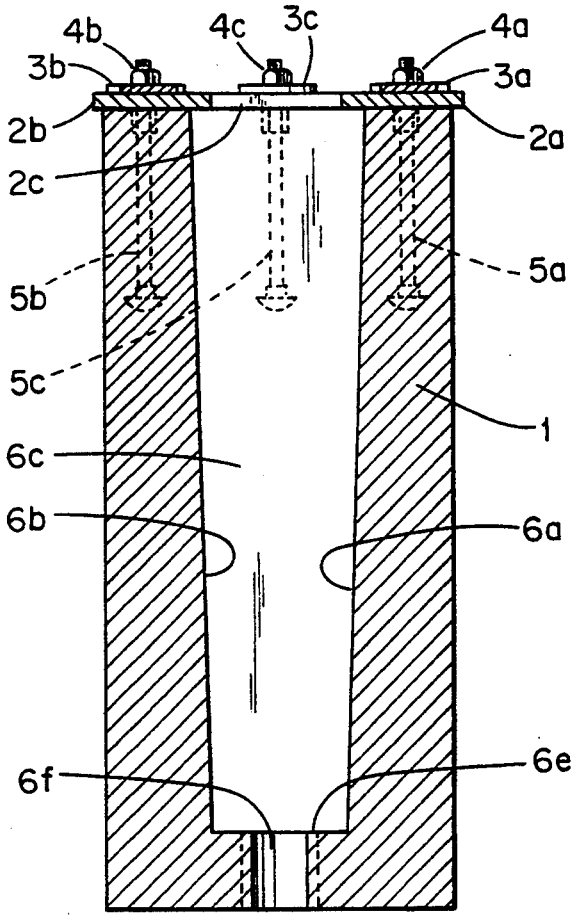
FIG. 2 is a cross-sectional view corresponding to the plane upon which the sectional view is taken shown in FIG. 3 and FIG. 4.

The base illustrated in FIGS. 1–3, 5 and 6 and made in accordance with the invention is comprised of a square prism bottom component 1 of heavy, cast material, such as concrete by way of example, acting as a weight and receiver of the post 7, 8, only the lower portion of which post is shown in FIGS. 5–6. The center portion of said bottom component is formed as a squared, four equal sided vertical tapered cavity with sides in plan view parallel to the base component sides, and is composed of downwardly and inwardly slanted, tapering faces 6*a*, 6*b*, 6*c*, 6*d*. The top edges of each slanted face which form the cavity top opening are wider than their corresponding bottom edges. Said slanted faces join a horizontal square cavity bottom plane surface 6*e* which is sized to the plan dimension of the post which is supported, and which has centered within it a drain hole (6*f*) extending downward and through the bottom component's lowermost surface. The post being inserted into the cavity is centered, supported, and horizontally restrained by the cavity's bottom surface 6*e* junction with the tapered cavity faces 6*a*, 6*b*, 6*c*, 6*d*. Between the cavity's bottom surface 6*e* and the bottom component's lowermost surface is essentially solid cast material with the exception of the drain hole 6*f*. Embedded within the base component 1 are threaded anchoring bolts 5*a*, 5*b*, 5*c*, 5*d* which protrude vertically above the bottom component's top surface.

The top component comprised of laterally movable metal anchoring plates with slotted holes 2*a*, 2*b*, 2*c*, 2*d*, metal fiat ring washers 3*a*, 3*b*, 3*c*, 3*d*, and metal threaded nuts 4*a*, 4*b*, 4*c*, 4*d*, all secured to the uppermost surface of the bottom component's 1 embedded anchor bolts 5*a*, 5*b*, 5*c*, 5*d*. The ability to move the anchoring plates 2*a*, 2*b*, 2*c*, 2*d* in the four primary orientations is provided by their slotted holes which allow movement of each said plate toward and away from the center point of the base component. The smaller anchoring plates 2*a*, 2*b*, correctly mounted on the base component in an opposite orientation from one another, are sized so as to be laterally adjustable between the larger anchoring plates 2*c*, 2*d*, thus providing a consistent and relocatable throat opening for plumb alignment of the post 7, 8.

The provision for the anchoring plates 2*a*, 2*b*, 2*c*, 2*d* to move laterally as shown in FIG. 6 allows the bottom component's anchor bolts 5*a*, 5*b*, 5*c*, 5*d* to receive only a small and acceptable portion of the forces resulting from vehicular impact with its restrained road sign post 7, 8. Said post 7, or post 8 having spacers 9*a*, 9*b* attached thereto by bolt assembly 10 as shown in FIG. 7, are therefor allowed to pivot a short distance before making contact with the bottom component's slanted cavity faces 6*a*, 6*b*, 6*c*, 6*d*, thereby transferring moment impact forces to the heavy mass of bottom component 1 and surrounding enclosure material before the anchoring plate 2*a*, 2*b*, 2*c*, 2*d* slotted hole walls are able to make damaging impact on their respective anchoring bolts 5*a*, 5*b*, 5*c*, 5*d*.

I claim:

1. An adjustable post anchoring system comprising in combination:

a base having a cavity and an uppermost surface, anchor bolts protruding from said base's uppermost surface, a group of horizontally adjustable anchoring plates with slotted holes, each of said anchoring plates anchored to said base's protruding anchor bolts, wherein (i) said cavity is comprised of a top opening, and a lowermost surface and wherein said lowermost surface is of an area less than the area of said top opening and (ii) said anchoring plates are arranged in opposing pairs with a first opposing pair of anchoring plates having sides in contact with and being adjustable in position between a second opposing pair of anchoring plates.

2. An adjustable post anchoring system according to claim 1, wherein said base is comprised of premanufactured heavy cast material shaped as a square prism.

3. An adjustable post anchoring system according to claim 1, wherein said cavity is further comprised of four equal sided tapered sloping walls.

4. An adjustable post anchoring system according to claim 3, further comprising a post inserted into said cavity wherein said post is centered within said cavity, is vertically supported by the lowermost surface of said cavity and is horizontally supported by at least one of said cavity walls and at least one of said adjustable anchoring plates.

5. An adjustable post anchoring system according to claim 4, wherein said adjustable anchoring plates are comprised of four anchoring plates, with one of the opposing pair of anchoring plates being smaller than and moveable between said other pair of anchoring plates.

6. An adjustable post anchoring system according to claim 5, wherein said anchoring plates can be adjusted to provide a relocatable throat opening for plumb alignment of the post and to bear against the full width of each surface of the post.

7. An adjustable post anchoring system according to claim 6, wherein the anchoring plates are adjusted so that the anchor bolts provide only a portion of the horizontal support of the post.

8. An adjustable post anchoring system according to claim 4, wherein said post is a road side post with spacers attached thereto so as to allow said post to pivot laterally before contacting the sides of the cavity walls.

9. An adjustable post anchoring system according to claim 4, wherein said base is adapted to resist moment impact forces resulting from the horizontal support of the post before the anchoring plates are able to make damaging impact to the anchor bolts.

10. An adjustable post anchoring system according to claim 3, further comprising a drain in the lowermost surface of said cavity.

11. An adjustable post anchoring system according to claim 3, wherein said sloping walls form a prism-shaped cavity.

12. An adjustable post anchoring system comprising:

a vertically symmetrical prism base having a square uppermost base surface, a square lowermost base surface and four base sides walls each connecting a side of said square lowermost base surface to a corresponding side of said uppermost base surface;

a symmetrical square prism cavity vertically centered within said base having a square upper cavity opening in said uppermost base surface, a square lower cavity surface within said base and being of an area smaller than the area of said square upper cavity opening, and four cavity side walls each connecting a side of said square upper cavity opening to a corresponding side of a lower cavity surface, wherein at any horizontal plane within said cavity each of the cavity side walls is parallel to a corresponding one of the base side walls;

anchor bolts protruding perpendicularly from said uppermost base surface, wherein each said anchor bolt is laterally located between one of said cavity side walls and the corresponding one of said base side walls;

four anchoring plates each having a slotted hole and located on the uppermost base surface, wherein (i) two of said anchoring plates being an identical pair of large anchoring plates and the other two being a relatively smaller pair of anchoring plates, (ii) each said anchoring plates comprising each said identical pair are arranged on opposite sides of the upper cavity opening, (iii) said smaller size identical pair of anchoring plates is laterally movable between said large identical pair of anchoring plates, and (iv) a respective one of said anchor bolts protrudes through each slotted hole;

nuts attached to respective anchoring bolts; and a drain centered in said lower cavity surface.

13. An adjustable post anchoring system according to claim 12 further comprising a post configuration having a bottom portion sized to snugly fit within the cavity side walls at the lower cavity surface and wherein said anchoring plates surround and bear against said post configuration.

* * * * *